United States Patent [19]

Colanzi

[11] 4,074,463

[45] Feb. 21, 1978

[54] ELECTRICALLY CONTROLLED WINDOW REGULATOR

[75] Inventor: Franco Colanzi, Turin, Italy

[73] Assignee: RIV - SKF Officine di Villar Perosa S.p.A., Turin, Italy

[21] Appl. No.: 723,384

[22] Filed: Sept. 15, 1976

[30] Foreign Application Priority Data

July 27, 1976 Italy ..... 68871/76

[51] Int. Cl.[2] ..... E05F 11/48

[52] U.S. Cl. ..... 49/352; 74/424.8 R; 74/501 R; 74/89.15; 49/349

[58] Field of Search ..... 49/348, 349, 352, 227, 49/40, 325; 74/424.8 R, 501 R

[56] References Cited

U.S. PATENT DOCUMENTS

| | | | |
|---|---|---|---|
| 2,311,972 | 2/1943 | Simpson | 49/349 X |
| 2,599,760 | 6/1952 | Hanson et al. | 49/325 X |
| 2,919,911 | 1/1960 | Furtah, Jr. | 49/349 X |
| 3,178,958 | 4/1965 | Beck | 74/424.8 R |
| 3,203,690 | 8/1965 | Werner | 49/349 X |

FOREIGN PATENT DOCUMENTS

| | | | |
|---|---|---|---|
| 826,806 | 1/1960 | United Kingdom | 49/227 |

*Primary Examiner*—Kenneth Downey
*Attorney, Agent, or Firm*—Ladas, Parry, Von Gehr, Goldsmith & Deschamps

[57] ABSTRACT

An electrically controlled window regulator for raising and lowering a mobile window of a motor vehicle door, and in which a slide rigidly connectable to said window is slidably mounted on a guide rigidly connectable to a support of said window, and is reciprocated by a flexible screw consisting at least partially of a precompressed spring extending through a rigid tubular member connected rotatably to said window support. The tubular member is provided with an inner volute with circulating balls coupled to the precompressed spring, and electrical drive means are provided to rotate the tubular member about its axis relative to said window support in one direction and to other.

5 Claims, 4 Drawing Figures

ELECTRICALLY CONTROLLED WINDOW REGULATOR

BACKGROUND OF THE INVENTION

This invention relates to a window regulator, particularly for raising and lowering a mobile window of a motor vehicle door.

In particular, the present invention relates to a window regulator of the type comprising slide means rigidly connectable to said window; a guide for said slide means, said guide being rigidly connectable to a support for said mobile window; an actuator element connected to said slide and arranged to make outward and return movements of translation to move said slide means along said guide between a closed and an open position; and electrical drive means for said actuator element.

In the construction of window regulators of the aforementioned type, one of the most difficult technical problems to solve is the choice of coupling to be used for connecting the said actuator element to the said electrical drive means. The type and cost both of the drive means and actuator element depend on the choice of this coupling, and moreover the coupling in itself must not only be most economical and precise but must also have a relatively high efficiency and reliability, and produce relatively slow movements of the said actuator element. In this respect, it should be noted that an electrically controlled window regulator which produces in the relative mobile window a speed of movement decidedly greater than that of mobile windows operated by normal manual devices would be unacceptable for safety reasons.

In some window regulators of the aforementioned type, an attempt has been made to solve the said technical problem by using an actuator element in the form of a flexible screw consisting of a spring would in the form of a helix about a flexible core or cable, and connecting this flexible screw to a nut screw consisting of an internally threaded sleeve rotated by an electric motor.

This method has numerous disadvantages which drastically reduce both its reliability and possibility of use, because a coupling of this type has a transmission ratio of 1 : 1, and the friction forces generated between the screw and nut screw when in use are generally relatively high because of the substantial impossibility of economically constructing a helical spring of satisfactory surface characteristics, and of the substantial inaccuracy of the pitch of the screw used, which in use tends to undergo permanent deformation. In this respect, it is evident that if the window is prevented from sliding or slowed down due to any accidental cause, the rotation of the nut screw leads to immediate stretching or compression of the spring with consequent sliding of the spring turns along the central core, and local pitch variation.

The low efficiency of the described coupling and its inability to act as a reducer automatically lead to the use of an electric drive motor of low speed and reltively high power to overcome the friction and, at the same time, keep the speed of movement of the window within acceptable limits. Such a motor is not only relatively costly, but because of its bulk it is difficult to house inside a door. Finally, the power absorbed by such a motor is generally excessive when considering that a mobile window of a motor vehicle must be able to be operated even when the vehicle engine is not running.

SUMMARY OF THE INVENTION

The object of the present invention is to provide a window regulator of the type heretofore specified, in which the aforementioned disadvantages are absent and which uses a relatively fast electric motor of relatively low power, while providing the relative window with a relatively low speed of movement.

The said object is attained by the window regulator of the type heretofore specified, according to the present invention, wherein the said actuator element is a flexible screw consisting at least partly of a precompressed spring extending through a rigid tubular member connectable rotatably to said window support and comprising a volute with circulating balls coupled to said precompressed spring; said electrical drive means being arranged to rotate said tubular member and said volute about their axis in one direction and the other.

The use, according to the present invention, of a volute with circulating balls not only leads to considerable reduction in friction between the screw and screw nut, but also allows a large reduction ratio to be introduced into the transmission of motion between the nut screw and screw, because a screw-nut screw coupling with circulating balls notably operates partly as an epicyclic reducer. This makes it possible to use electric drive motors of relatively small dimensions and power, of high speed and of relatively low cost. Finally, by giving the said spring a precompression of a value at least equal to the maximum traction force which can be exerted by the volute, it is possible to obtain a flexible actuator element of characteristics which, at the coupling, are substantially similar to those of a rigid screw.

BRIEF DESCRIPTION OF THE DRAWINGS

Further characteristics and advantages of the present invention will be more evident from the decription given hereinafter with reference to the accompanying drawings, which illustrate one embodiment by way of non-limiting example, and in which.

DETAILED DESCRIPTION OF THE INVENTION

Figure 1:
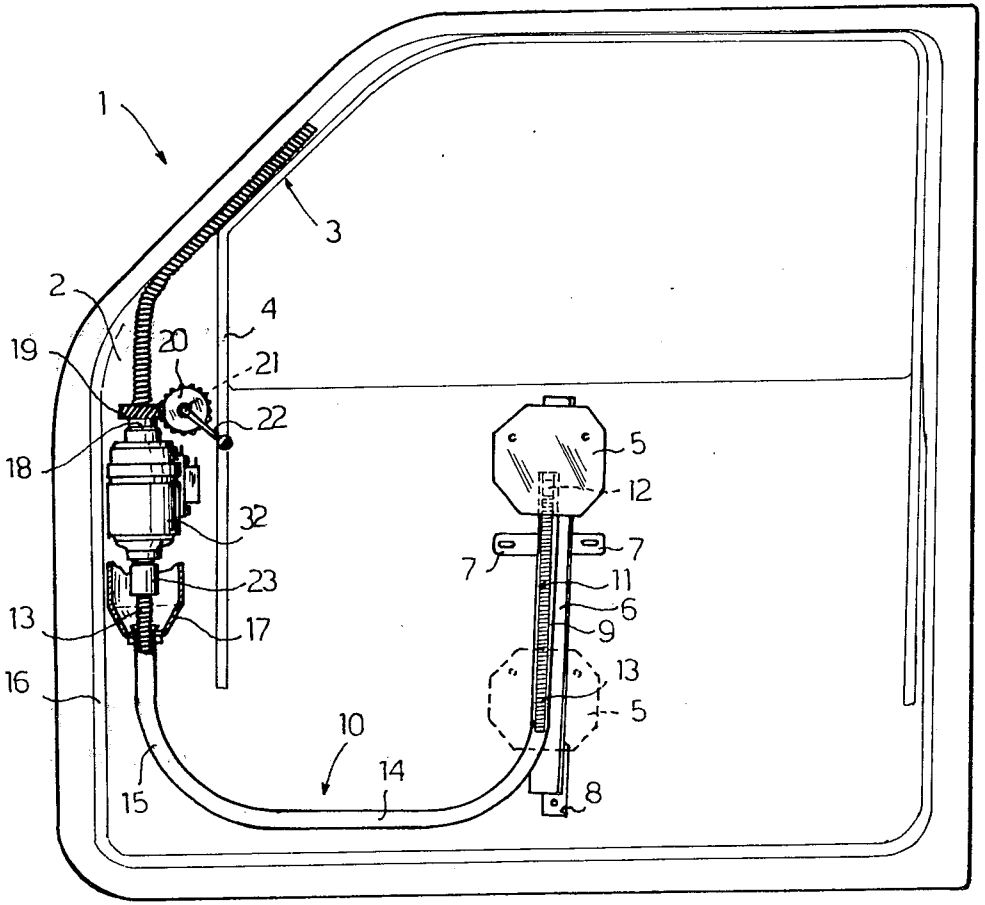
FIG. 1 is a diagrammatic elevation of a window regulator constructed in accordance with the present invention.

FIG. 1 shows a motor vehicle door 1, comprising a frame 2 with an aperture 3 closed by a mobile window, not shown, mounted to slide along side channels 4 extending downwards inside the lower part of the frame 2.

To the lower end of the mobile window is connected a plate 5 mounted to slide along a rigid guide 6 of substantially angular section and extending in a substantially vertical direction. The guide 6 is disposed inside the lower closed part of the door 1, and is connected to the frame 2 by two upper brackets 7 and a lower bracket 8. Along the guide 6 there extends a substantially straight end portion 9 of a conduit or sheath 10 comprising an axial slit 11 along the entire portion 9 through which an appendix 12 rigid with the plate 5 extends. The free end of the appendix 12 is rigidly connected to the end of a flexible actuator element 13 consisting of a precompressed spring slidably mounted in the sheath 10, to move the plate 5 between an upper position (shown in FIG. 1 with a full line) corresponding to the raised or closed position of the mobile window, and a lower position (shown in FIG. 1 by a dashed and dotted line) corresponding to the lowered or open position of the mobile window.

The sheath 10 is bent substantially in the form of a U and, in addition to the portion 9, comprises a lower portion 14 extending substantially along the bottom of the frame 2, and a portion 15 extending upwards in the space lying between an end side wall 16 of the frame 2 and one of the side channels 4, and supported at its upper end by a bracket 17 connected to the frame 2.

The spring 13 emerges from the upper end of the portion 15 of the sheath 10 and extends through a rigid tubular member 18 disposed in a substantially vertical position and comprising a helical gear 19 keyed to its upper end. This latter gear engages with a helical gear 20 keyed on a shaft 21 rotatably mounted on the frame 2 and substantially perpendicular to the tubular member 18. A handle 22, operable from within the vehicle to rotate the gear wheel 20, is removably connectable to the shaft 21.

Figure 4:
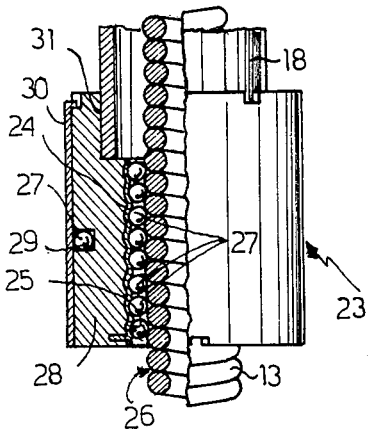
FIG. 4 is a partial axial section through a second detail of FIG. 1.

A volute 23 is connected to the lower end of the tubular member 18, and, as shown in FIG. 4, comprises an internal thin walled sleeve 24 of hardened steel and shaped to define internally a helical groove 25 of pitch substantially equal to that of a groove 26 defined by the neighbouring turns of the precompressed spring 13. This latter extends with radial slack through the sleeve 24 and is coupled to it by a group of balls 27 arranged to move along a helical rolling path defined by the grooves 25 and 26. An external sleeve 28 of reinforced plastics or sintered steel is moulded on the outer surface of the sleeve 24, with its external surface comprising an oblique groove 29. This latter is connected at its two ends by way of holes, now shown, with two points of the said helical rolling path which are spaced-apart axially. The groove 29 acts both as a recycling channel for the balls 27 and as an aperture for introducing these balls into the said helical rolling path. Once the balls 27 have been inserted, the channel 29 is closed towards the outside by a sleeve 30 keyed on the sleeve 28. This latter has a annual axial appendix 31 in which the lower end of the tubular member 18 is inserted.

As shown in FIG. 1, the tubular member 18 constitutes the central hollow shaft of a reversible electric motor 32 supported by the frame 2, and its operation in one direction or the other causes rotation in one direction or the other of the hollow member 18, and consequently of the volute 23, and translation in one direction or the other of the spring 13 with consequent raising or lowering of the mobile window.

If, for any accidental reason, it is impossible to operate the motor 32, the mobile window may be moved manually using the handle 22.

Figure 2:
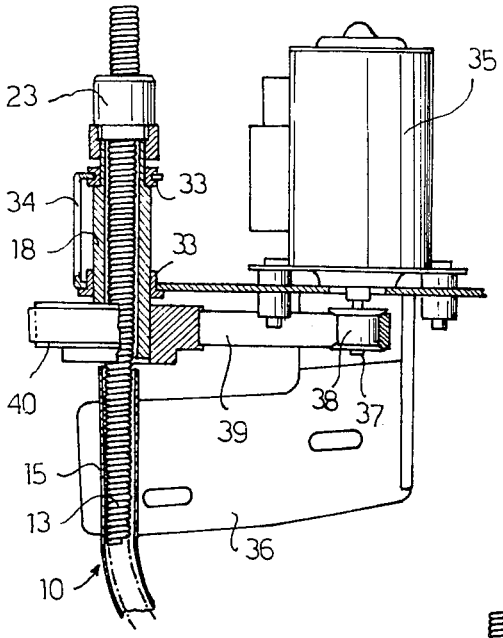
FIG. 2 is a partially sectional elevation of a first modification of a first detail of FIG. 1.

As shown in the modification of FIG. 2, the tubular member 18 supports the volute 23 at its upper end, and is supported rotatably by two sleeves 33 mounted on a bracket 34 rigid with the casing of a reversible electric motor 35 connected to the frame 2 by a bracket 36. A pulley 38 is keyed on an exit shaft 37 of the motor 35, and is connected by a belt drive 39 to a pulley 40 keyed on the tubular member 18.

The drive device shown in FIG. 2 may also be provided with a manual control (not shown), which may consist for example of a helical gear wheel (not shown) rigid angularly with the volute 23 and cooperating with the helical gear wheel 20 operable by the handle 22.

Figure 3:
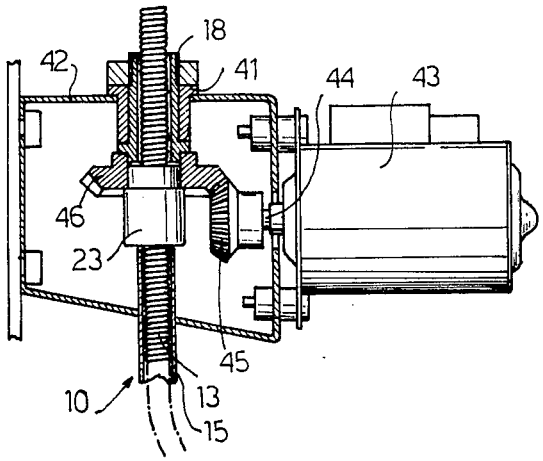
FIG. 3 is a partially sectional elevation of a second modification of said first detail of FIG. 1.

In the modification shown in FIG. 3, the tubular member 18 is rotatably supported by a support sleeve 41 on a horizontally extending frame 42. This latter is connected at one end to the wall 16, and at the other end supports a reversible electric motor 43 disposed in a substantially horizontal position in the lower part of the door 1. A bevel pinion 45 is keyed on to an exit shaft 44 of the motor 43, and engages with a bevel pinion 46 keyed on to the tubular member 18.

As in the of the drive device shown in FIG. 1, the drive device shown in FIG. 3 may also be provided with a manual control (not shown) which may consist for example of a helical gear wheel (not shown) angularly rigid with the volute 23 and cooperating with the helical gear wheel 20 operable by means of handle 22.

Various modifications may be made to the window regulators described by way of non-limiting example, without leaving the scope of the present invention. For example, although the use of a volute with circulating balls of the type shown in FIG. 4 is advisable because of its cheapness, it is evident that any other type of circulating ball volute may be used to transmit motion to the precompressed spring 13.

What we claim is:

1. An electrically controlled window regulator, particularly for raising and lowering a window mounted in a motor vehicle door, the regulator comprising:

slide means rigidly connectable to said window;

a guide for said slide means, said guide being rigidly connectable to a support for said window;

a flexible screw connected to said slide means and arranged to make outward and return translatory movements to move said slide means along said guide between a closed and an open position, said flexible screw consisting at least partly of a precompressed spring;

a flexible sheath in which said flexible screw extends in slidable manner, said flexible sheath having an end portion which extends along said guide and is formed with a slot-form opening extending therealong;

an appendix connecting said slide means to said flexible screw and extending through said slot-form opening in said flexible sheath;

a recirculating ball nut through which the precompressed spring extends and which is coupled drivingly to said precompressed spring, whereby rotation of the ball nut brings about translation of the flexible screw; and a reversible electric motor connectable to said support and having a central hollow through shaft which is rotated upon operation of the motor, the flexible screw extending through said shaft and said shaft being connected to said recirculating ball nut so that the ball nut rotates with said shaft.

2. A window regulator as claimed in claim 1, further comprising a manually operable handle mounted for rotary movement, and a transmission for transmitting rotary movement of the handle to said shaft.

3. An electrically controlled window regulator, particularly for raising and lowering a window mounted in a motor vehicle door, the regulator comprising:

slide means rigidly connectable to said window;

a guide for said slide means, said guide being rigidly connectable to a support for said window;

a flexible screw connected to said slide means and arranged to make outward and return translatory movements to move said slide means along said guide between a closed and an open position, said flexible screw consisting at least partly of a precompressed spring;

a flexible sheath in which said flexible screw extends in slidable manner, said flexible sheath having an end portion which extends along said guide and is formed with a slot-form opening extending therealong;

an appendix connected said slide means to said flexible screw and extending through said slot-form opening in said flexible sheath;

a recirculating ball nut through which the precompressed spring extends and which is coupled drivingly to said precompressed spring, whereby rotation of the ball nut brings about translation of the flexible screw;

a rigid bracket or frame which is rigidly connectable to said support;

a rigid tubular member which is rotatably mounted in an axially fixed position on said bracket or frame and through which said flexible screw extends, said tubular member being connected to said recirculating ball nut so that the tubular member and the ball nut rotate together;

a reversible electric motor; and transmission means connecting said motor to said tubular member to drive the tubular member to rotate.

4. A window regulator as claimed in claim 3, wherein said transmission means comprise a pair of mutually cooperating gear wheels, one keyed on to an exit shaft of said motor and the other keyed on to said rigid tubular member.

5. A window regulator as claimed in claim 3, wherein said transmission means comprise a pair of pulleys on which a belt is wound, and which are keyed one on to an exit shaft of said motor and the other on to said rigid tubular member.

* * * * *